US005465843A

United States Patent [19]

Koefelda

[11] Patent Number: 5,465,843

[45] Date of Patent: Nov. 14, 1995

[54] NESTABLE DISPLAY CRATE FOR BOTTLES OR THE LIKE

[75] Inventor: Gerald R. Koefelda, Atlanta, Ga.

[73] Assignee: Rehrig Pacific Company, Los Angeles, Calif.

[21] Appl. No.: 268,997

[22] Filed: Jun. 30, 1994

Related U.S. Application Data

[63] Continuation-in-part of Ser. No. 18,317, Feb. 3, 1994.

[51] Int. Cl.[6] ..... B65D 21/04

[52] U.S. Cl. ..... 206/507; 206/505; 206/509

[58] Field of Search ..... 206/505, 507, 206/508, 509, 427, 203, 563, 564, 821; 220/509, 516, 519, DIG. 2, DIG. 15, 4.26, 513

[56] References Cited

U.S. PATENT DOCUMENTS

| | | | |
|---|---|---|---|
| D. 224,366 | 7/1972 | Rehrig . | |
| D. 244,486 | 5/1977 | Johnson et al. . | |
| D. 247,648 | 3/1978 | Carroll et al. . | |
| 3,009,579 | 11/1961 | Ettlinger, Jr. . | |
| 3,052,373 | 9/1962 | Frater . | |
| 3,265,237 | 8/1966 | Pache et al. . | |
| 3,270,913 | 9/1966 | Bridenstine et al. . | |
| 3,332,574 | 7/1967 | Earp . | |
| 3,349,943 | 10/1967 | Box . | |
| 3,744,707 | 7/1973 | Ross . | |
| 3,794,208 | 2/1974 | Roush et al. . | |
| 3,997,057 | 12/1976 | Craig | 206/507 |
| 4,011,948 | 3/1977 | Rehrig et al. . | |
| 4,095,720 | 6/1978 | Delbrouck et al. . | |
| 4,101,049 | 7/1978 | Wallace et al. | 206/507 |
| 4,105,117 | 8/1978 | Atkin et al. . | |
| 4,143,764 | 3/1979 | Moss, III . | |
| 4,256,224 | 3/1981 | Hirota . | |
| 4,319,685 | 3/1982 | David . | |
| 4,410,099 | 10/1983 | deLarosiere . | |
| 4,759,451 | 7/1988 | Apps . | |
| 4,773,554 | 9/1988 | Warwick . | |
| 4,899,874 | 2/1990 | Apps et al. . | |
| 4,928,841 | 5/1990 | Arthurs . | |
| 4,932,532 | 6/1990 | Apps et al. . | |
| 4,944,400 | 7/1990 | Van Onstein et al. | 206/509 |
| 4,978,002 | 12/1990 | Apps et al. | 206/509 |
| 5,060,819 | 10/1991 | Apps . | |
| 5,096,085 | 3/1992 | Eek et al. . | |
| 5,097,980 | 3/1992 | Warwick . | |
| 5,105,948 | 4/1992 | Morris et al. . | |
| 5,335,814 | 8/1994 | Hepp | 206/519 |
| 5,426,890 | 6/1995 | Dummen | 206/507 |

FOREIGN PATENT DOCUMENTS

| | | |
|---|---|---|
| 1351218 | 12/1963 | France . |
| 2801077 | 7/1978 | Germany . |
| 2712748 | 9/1978 | Germany . |
| 725683 | 11/1966 | Italy . |
| PCT/US89/03737 | 12/1990 | WIPO . |

*Primary Examiner*—Stephen J. Castellano
*Attorney, Agent, or Firm*—Banner & Allegretti, Ltd.

[57] ABSTRACT

A low depth, nestable display crate for bottles, preferably of single serve capacity, is integrally molded from plastic and comprises two basic components— a floor and a wall structure extending up from the floor and extending around the periphery of the floor. The floor preferably has an open lattice design and includes container support areas. The bottom surface of the floor is configured for accommodating the tops of bottles in a similar crate underneath. The wall structure comprises a lower wall portion adjacent the floor and a plurality of integrally formed pylons arranged around the periphery of the crate. The lower wall portion is of double-walled construction with the hollow pylons integrally formed the double-walled lower portion. The pylons are angled toward the interior of the crate and tapered to be smaller in cross section at the top and larger near the lower wall portion so as to allow pylons of empty crates to nest within one another. The crate of the present invention combines the advantages of a nesting crate with sufficient strength afforded by its double-walled construction and maximum, unobstructed visibility of the bottles.

20 Claims, 10 Drawing Sheets

NESTABLE DISPLAY CRATE FOR BOTTLES OR THE LIKE

CROSS-REFERENCE TO RELATED APPLICATION

This application is a continuation-in-part of co-pending design patent application Ser. No. 29/018,317 filed Feb. 3, 1994 now pending.

BACKGROUND OF THE INVENTION

The present invention relates to a nestable display crate for transporting and storing containers, more particularly, the present invention relates crates or trays that combine nestability and high strength with high visibility for displaying bottles.

Bottles, particularly tier soft drinks and other beverages, are often stored and transported during the distribution stages thereof in crates or trays. The term "crate" or "tray" as used herein includes crates, trays and similar containers having a bottom and peripheral sidewall structure. These crates generally are configured to be stacked on top of each other when loaded with bottles, and nested together when empty of bottles. The plastic crates provide advantages such as conservation of storage space and efficient, easy handling and recyclability. In order to minimize the storage space of the crates when nested and to reduce cost and weight, many crates today are made with a shallow peripheral sidewall structure. These generally are referred to as "low depth" crates in which the bottles bear most of the load of above-stacked crates. Crates having a higher peripheral sidewall, approximately the same height as the bottles generally are referred to as "full depth" crates in which the crates themselves bear most of the load of above-stacked crates.

Low depth crates are generally less expensive and lighter in weight than similarly constructed full depth crates. Thus, low depth crates are used extensively. Generally, low depth crates have been designed with a plurality of columns interconnecting a top band to a floor. An example of such a low depth tray for cans is disclosed in commonly assigned U.S. Pat. No. 5,184,748, the disclosure of which is hereby incorporated by reference in its entirety. The tray disclosed in the '748 patent is a nestable tray meaning that identical empty trays can be nested together to conserve retail or storage space.

Another example of a known low depth bottle crate for bottles of single serve capacity is disclosed in commonly assigned U.S. Pat. No. 5,060,819, the disclosure of which is also hereby incorporated by reference in its entirety. The bottle crate of the '819 patent has a single-thickness sidewall structure with upright adjacent panels, alternating ones of which are raised such that their lower surfaces are spaced above the floor. The top and bottom edges of the sidewall thereby have an undulating configuration such that empty trays can nest together.

Single serve bottles are generally packed by bottlers in cases or other containers, several bottles to the case, for shipment to retailers or for storage. Cases of bottles are customarily stacked on top of each other. One way of handling the cases of bottles is to stack the cases on pallets which can be lifted and moved about by fork-lift trucks. A technique for interconnecting columns of cases, is called cross-stacking, and is often used to improve stability of a stack of cases, or for display purposes by the retailer. There has been a need for bottle cases having structural features which facilitate handling of stacked and cross-stacked loaded cases, enhances stability of stacked columns of such cases and provides maximum visibility of the bottles, especially in a retail setting.

One of the problems associated with previous nestable crates, particularly, those for single serve bottles, has been lack of strength when used in some settings. The tray of the '819 patent, for instance, has a single-thickness sidewall which may not stand up to very rough handling over time. Accordingly there has been a need for reusable nestable crates having the requisite strength and rigidity to withstand repeated or rough handling.

Another problem experienced with previous nestable crates has been limited visibility of the bottle or container labels. Although the column and band trays, such as the one disclosed in the '748 patent, do allow for much of the labels to be displayed, the band obstructs the view of the containers to some degree. Similarly, the undulating sidewall of the '819 tray allows for some interrupted visibility. There has been a need for a nestable crate which is sufficiently strong but does not sacrifice bottle or container visibility in strengthening the crate structure.

In many instances bottles having the same or similar capacity may have differently sized bottle tops. There has been a need for a single crate which can securely engage differently sized bottle tops in a similar crate therebeneath.

SUMMARY OF THE INVENTION

Accordingly, it is a principal object of the present invention to provide a low depth bottle crate which is nestable with other similar crates when empty to conserve space, and which is stackable and cross-stackable with other similar crates when loaded with bottles or containers for storing, displaying and transporting the containers. The crate of the present invention includes features for nesting empty crates and for stably stacking and cross-stacking loaded crates.

Another object of the present invention is to provide a low depth, nestable crate which has sufficient structural strength to withstand repeated and rough handling.

Another object of the present invention is to provide a sturdy low depth, nestable crate which also provides maximum visibility of the bottles or containers for display purposes.

Still another object of the present invention is to provide a low depth, nestable crate which makes efficient use of space both when loaded and stacked and when empty and nested. When loaded and stacked, the present invention also has structural features which securely engage the tops of variously sized bottle tops.

Directed to achieving these objects, a new low depth, nestable crate for bottles is herein provided. The preferred configuration is for single serve capacity bottles of sixteen or twenty ounce capacity. It will be understood that while the preferred embodiment of the present invention is configured for retaining bottles, the crate may be used to store or transport any type of container. This crate is formed by integrally molding from plastic, two basic components - a floor and a wall structure extending up from the floor and extending around the periphery of the floor.

The floor preferably has an open lattice design which not only allows unwanted fluids to drain out of the crate, but also requires less material and thus is lighter than a solid floor design. The floor also has container support areas, preferably in an array.

The floor of the crate has an outer or bottom surface which is configured for accommodating the tops of bottles in a similar crate underneath. The floor bottom surface preferably has upwardly recessed receiving areas disposed to receive the tops of bottles contained in a similar crate therebeneath. The receiving areas aid in retaining the bottles in vertically upright positions which enhances the stability of stacked loaded crates. Directed to this feature, the receiving areas are each constructed to securely receive at least two different sizes of bottle tops. The receiving areas also prevent a crate from free-sliding along the tops of bottles in a crate underneath it. The peripheral surfaces of the receiving areas are beveled to allow the crate to disengage the tops of the bottles when the crate is rotated about a vertical axis so that once disengaged, the crate may slide along the tops of the bottles in the lower crate to facilitate handling.

The wall structure comprises a lower wall portion adjacent the floor and a plurality of integrally formed pylons arranged around the periphery of the floor of the crate. It will be understood that "pylon" denotes the upwardly extending hollow columns or posts. The lower wall portion is of double-walled construction since the hollow pylons naturally lend themselves to being integrally formed with such a double-walled lower portion. The hollow pylons are preferably angled toward the interior of the crate and tapered to be smaller in cross section at the top and larger near the lower wall portion so as to allow pylons of empty crates to nest within one another.

The pylons are preferably arranged around the periphery of the floor of the crate. One pylon is at each corner, and one pylon is positioned between adjacent support areas of the floor so that in profile, the crate has a sawtooth-like appearance as shown in FIGS. 1 and 2. The bottles loaded in the crate are visible through the open spaces between the pylons as shown in FIGS. 16–18. The crate of the present invention combines the advantages of a nesting crate with sufficient strength afforded by its double-walled construction with maximum, unobstructed visibility of the bottles.

These and other features and advantages of the invention may be more completely understood from the following detailed description of the preferred embodiments of the invention with reference to the accompanying drawings.

DETAILED DESCRIPTION OF THE PREFERRED EMBODIMENTS

The present invention is a low depth crate which has structural features to afford sufficient strength, facilitate nesting of empty crates and stable stacking and cross-stacking of loaded crates, and provide maximum visibility to the bottles or containers. The present invention is especially adaptable for single serve capacity bottles, either glass or plastic.

Figure 1:
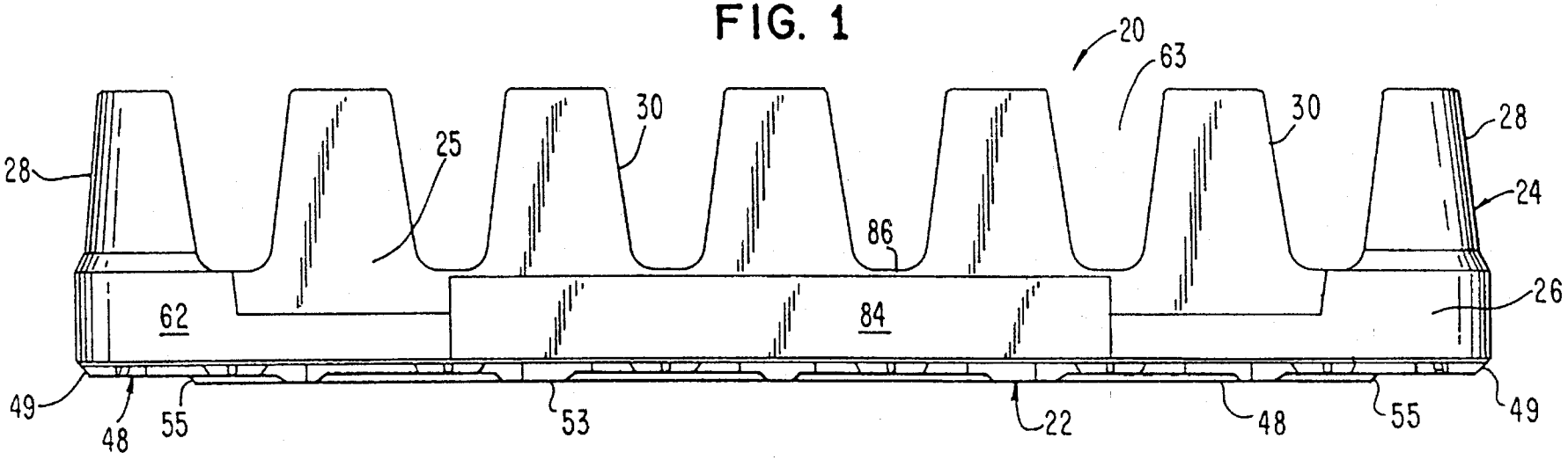
FIG. 1 is a side elevational view of a sidewall of the crate in accordance with the first preferred embodiment of the present invention.
Figure 2:
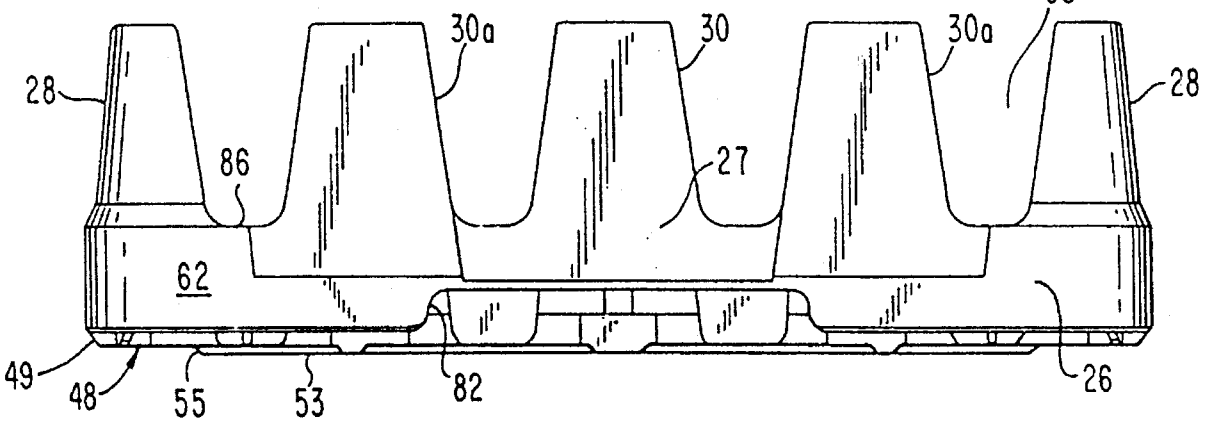
FIG. 2 is an end elevational view of the endwall of the crate of FIG. 1.

Referring to FIGS. 1 and 2, the crate 20 comprises two basic elements, a floor 22 and a wall structure 24. The wall structure that defines the periphery of crate 20 comprises a lower wall portion 26 and a plurality of pylons including corner pylons 28 and side pylons 30 and **30*a*. Crate 20 is preferably rectangular and the wall structure comprises sidewalls 25 and endwalls 27**. Although a rectangular crate is shown and described, the present invention is not limited thereto and may comprise sidewalls and endwalls of equal length resulting in a square crate.

Figure 3:
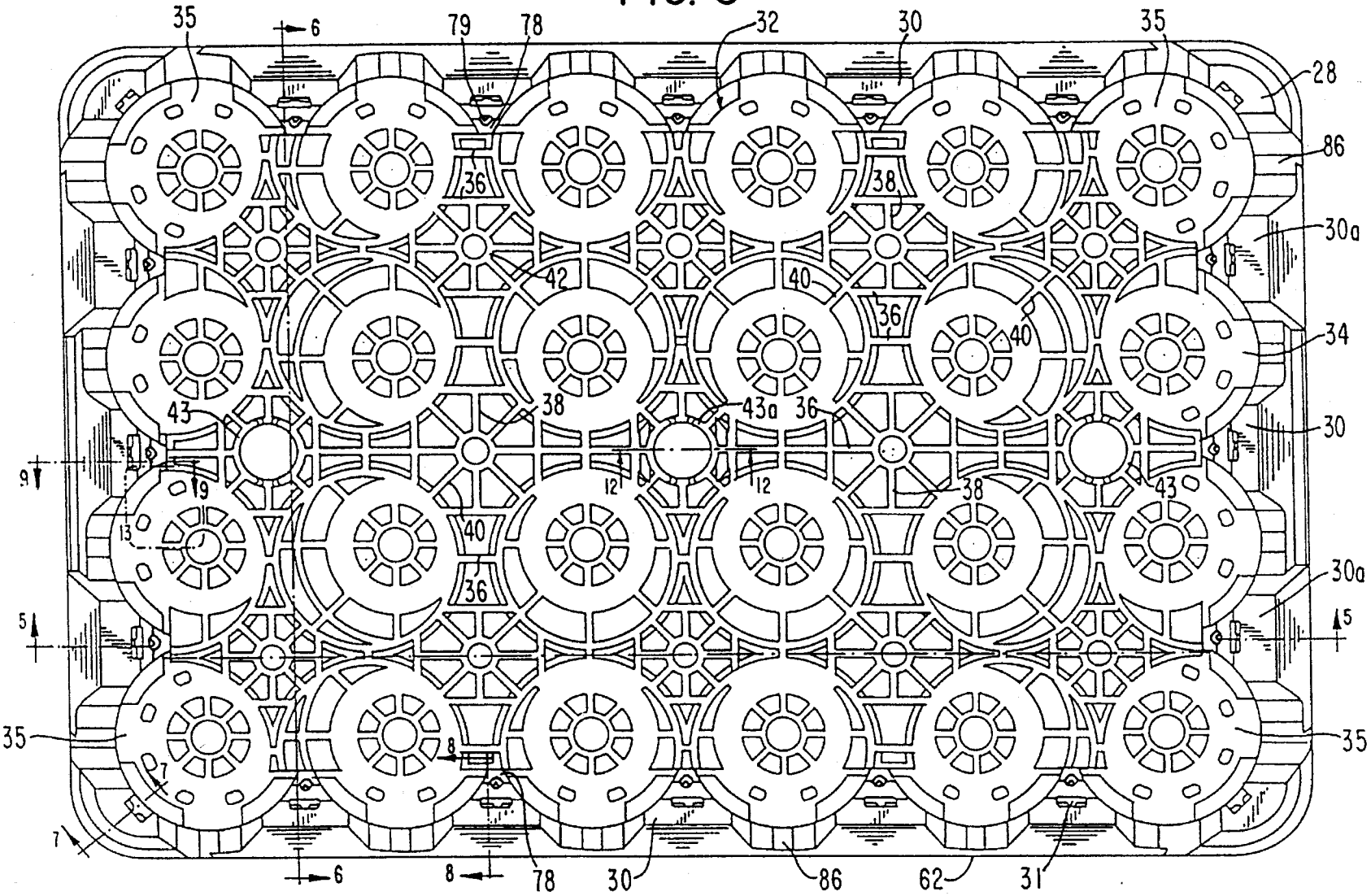
FIG. 3 is a top plan view of the crate of FIG. 1.
Figure 4:
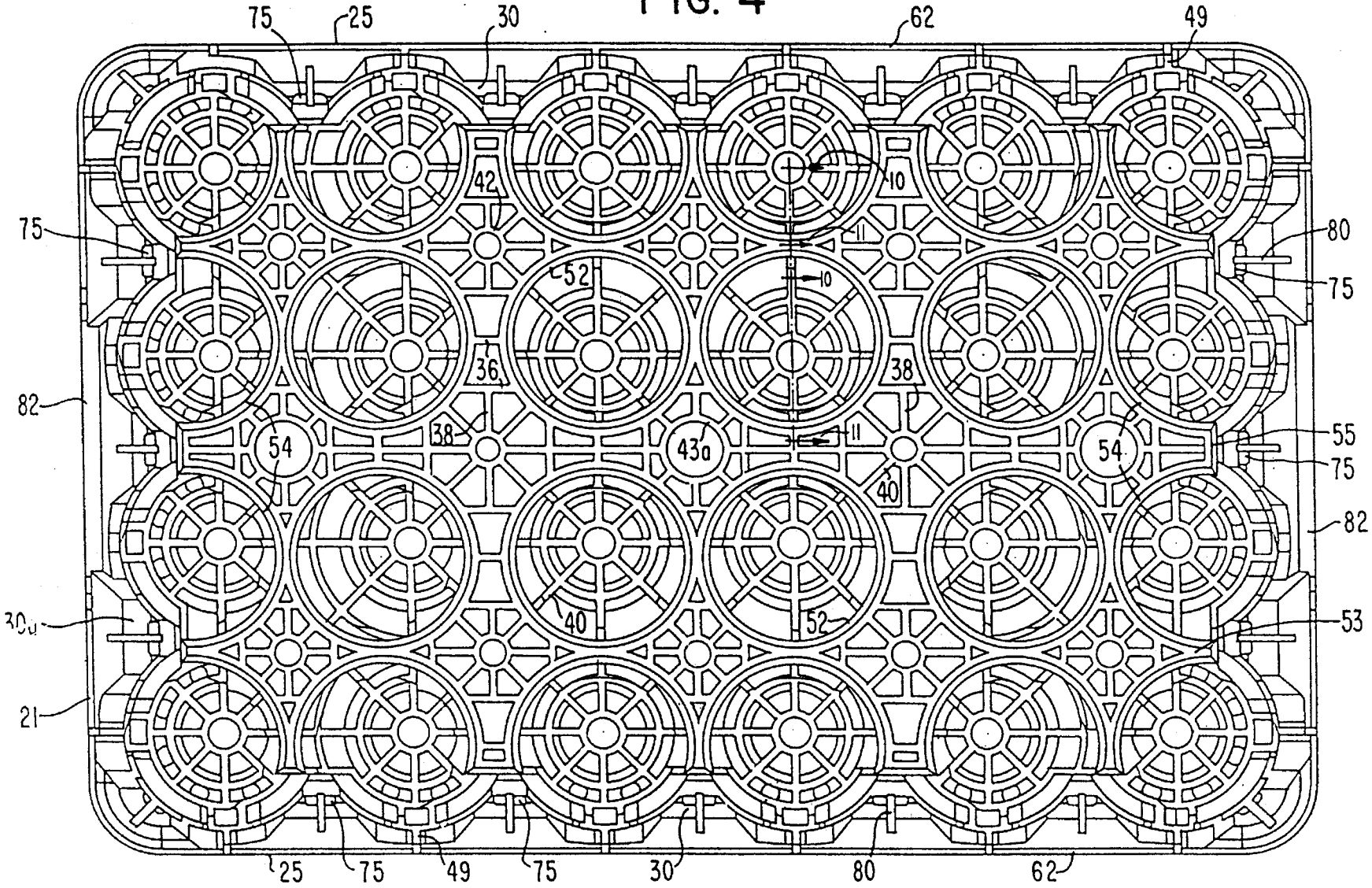
FIG. 4 is a bottom plan view of the crate of FIG. 1.

Floor 22 preferably has a lattice-like configuration having a pattern of open spaces as seen in FIGS. 3 and 4, which illustrate the top and bottom views of the floor respectively. The open floor design provides a light weight crate, and is practical for allowing any liquids to drain through floor 22. The floor is generally flat and open so as not to interfere with secondary wraps or binding means around multi-packs of bottles such as plastic wrap.

Figure 12:
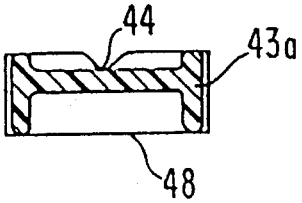
FIG. 12 is a cross section of the crate taken along line 12—12 of FIG. 3.

Referring to FIGS. 1–4, floor 22 has an upper or top surface 32 which is generally flat and includes a plurality of preferably circular support areas or rings 34 for supporting bottles thereon. Arranged at the corners of crate 20 are corner support areas 35 which are similar to support areas 34 in most respects, and will be described in detail herebelow. Support areas 34 and 35 are connected to each other by a system of grid-like longitudinal struts 36 and lateral struts 38 traversing floor 34 in perpendicular relation to one another, and diagonal struts 40 extending preferably radially from support areas 34. Interstitial lattice members 42 are preferably circular elements located between support areas 34 and 35 and are integrally formed with the longitudinal, lateral and diagonal struts. Perpendicular struts 36 and 38 extend generally the full length and width of floor 22, and connect the rows and columns of support areas 34 and corner support areas 35. Some perpendicular struts 36 and 38 are joined radially to circular lattice members 42. Diagonal struts 40 radially connect lattice members 42 and support areas 34 and 35. Lattice members 42 are preferably in uniform size except for three larger circular lattice members 43 located along the longitudinal axis of the crate from endwall to endwall. The central lattice member 43*a* is shown in cross section in FIG. 12, and is the preferred location of injection point 44 for injection molding crate 20.

Support areas 34 and 35 are arranged in rows and columns to thereby define one or more arrays. In one of the preferred embodiments, a four by six array accommodates twenty-four sixteen or twenty-ounce bottles. In the other preferred embodiments, one liter bottles may be arranged in a three by four array of twelve or in a three by five array of fifteen. Support areas 34 are configured so that bottles in an array are retained in relatively close relation so as to prevent jostling of the bottles during handling. Excess movement of the bottles is to be avoided in order to ensure that the bottles remain in a vertically upright position to most advantageously bear the load of bottles stacked or cross-stacked thereabove.

Figure 13:
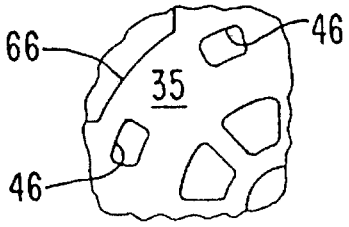
FIG. 13 is an enlarged, detailed view of area 13 shown in FIG. 3.

Each support area or ring 34, 35 is sized to seat bottles and is connected to the other support areas by perpendicular struts 36, 38 and diagonal struts 40. Support areas 34 and 35 preferably have solid, generally flat surfaces with the support areas around the periphery of the crate having drain holes 46. FIG. 13 illustrates a detailed view of a portion of a corner support area 35, the area marked in FIG. 3.

Floor 22 has a bottom surface 48 which has distinctive structural features. Floor bottom surface 48 is configured to allow for stacking and cross-stacking of loaded crates. Cross-stacking is done by rotating a top crate 90 degrees about a vertical axis and lowering onto a bottom crate or crates. During shipping and handling crates may be moved by machines and it is advantageous to use crates which can be stably stacked or cross-stacked. Additionally, when the crates are used to display the containers in a retail setting, the retailer may wish to cross-stack the crates for display or space reasons.

Figure 6:
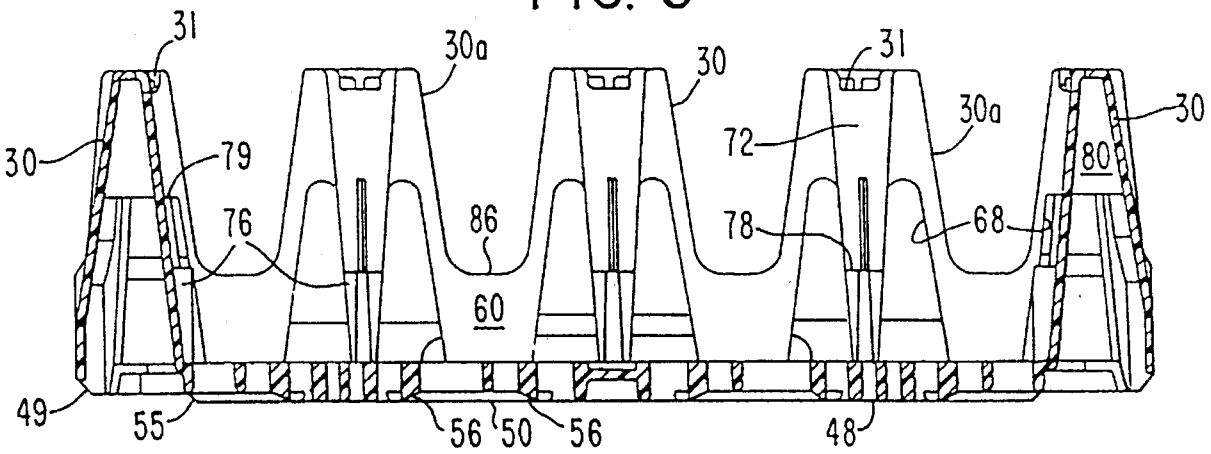
FIG. 6 is a cross sectional view of the crate taken along line 6—6 of FIG. 3.
Figure 10:
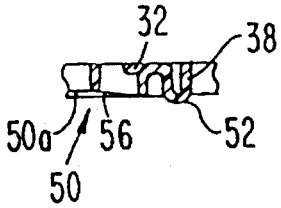
FIG. 10 is a cross section of the crate taken along line 10—10 of FIG. 4.
Figure 11:
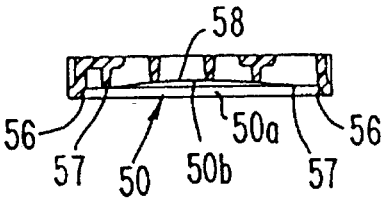
FIG. 11 is a cross section of the crate taken along line 11—11 of FIG. 4.

Floor bottom surface 48 has a plurality of upwardly recessed bottle top receiving areas 50, best shown in FIGS. 4, 6 and 11. The peripheries of the recessed receiving areas 50 are defined by circles 52 and arcs 54 which are integrally molded with and form part of floor bottom surface 48. The positions of circles 52 and arcs 54 are determined to provide a range within which the bottle tops in a loaded crate therebeneath may reside and still provide sate stacking and cross-stacking. Receiving areas 50 help retain bottles in vertically upright positions to bear the load of bottles stacked or cross-stacked thereabove. In general, peripheral receiving areas 50, that is, those adjacent to the wall structure defined by arcs 54, and the central receiving areas are defined by circles 52. Receiving areas 50 which are centrally located on the floor bottom surface are less offset from their corresponding support areas 34 than those nearer the wall structure. A detailed cross section of a portion of a circle 52 is shown in FIG. 10.

The peripheral surfaces of receiving areas 50 are beveled surfaces 56. In the stacked or cross-stacked positions, the receiving areas prevent a crate from sliding freely along the bottle tops in a lower crate, once the receiving areas are disengaged from their retaining positions, that is the stacked or cross-stacked positions, the upper crate may slide along the bottles tops in the lower crate to facilitate handling. Bevel 56 allows crate 20 to ride up onto the bottle tops in a lower crate when the upper crate is rotated slightly about a vertical axis.

A detailed cross section of a receiving area 50 is shown in FIG. 11. A detailed view of receiving area 50 in FIG. 11 illustrates that it is more than a simple indentation. Receiving area 50 is constructed to accommodate more than one size of bottle tops. There are actually two concentric receiving zones: the outer zone 50*a* and the inner zone 50*b*. In the first preferred embodiment, outer zone 50*a* is defined by the beveled surface 56 around the periphery of the receiving area 50, and can accommodate a bottle top having a 38 mm diameter. The area immediately inside of bevel 5*b* is preferably a flat area 57, and in the first preferred embodiment is approximately 5 mm wide. Inner zone 50*b* is preferably defined by a spherical surface 58 whose edge is concentric to the bevel 56. Spherical surface 58 is further recessed upward than receiving area 50, and in the first preferred embodiment, snugly engages a bottle top having a 28 mm diameter. The edge of spherical surface 58 may facilitate disengaging the bottle tops therebeneath for sliding the crate along the bottle tops. For the other preferred embodiments it will be understood that while the dimensions may vary, the inner and other receiving zones are constructed as described above, appropriately proportioned for the particular crate.

Crate 20 of the present invention holds a relatively closely packed arrangement of bottles, and the crate may be slid along the bottle tops. This is due to the closely packed arrangement of bottles which tend to be more vertically stable.

Wall structure 24 defines the periphery of crate 20 with opposing sidewalls 25 and opposing end walls 27. Wall structure 24 has a lower wall portion 26, the interior 60, of which is integral with floor 22. The corners of crate 20 are rounded and integral with lower wall portion 26. A corner pylon 28 is formed in each corner 20. In addition to the corner pylons, arranged along sidewalls 25 and endwalls 27 are a plurality of side pylons 30 and 30*a*. All pylons 28, 30 and 30*a* are integrally formed with lower wall portion 26 and with the floor. Pylons 28, 30 and 30*a* are preferably hollow, and extend upward from the floor and beyond the top surface of lower wall portion 26. In order to allow for nesting of empty crates, pylons 28 and 30 and 30*a* are preferably angled toward the interior of the crate, and tapered so that their cross sections at their tops are smaller than their cross sections nearer the lower wall portion.

Figure 5:
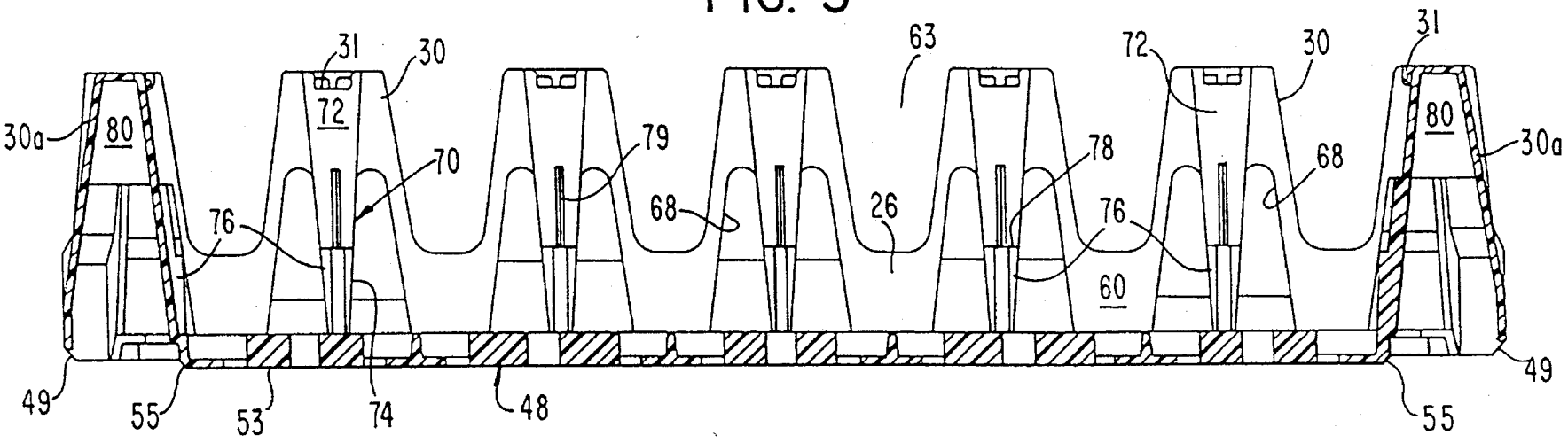
FIG. 5 is a cross sectional view of the crate taken along line 5—5 of FIG. 3.
Figure 7:
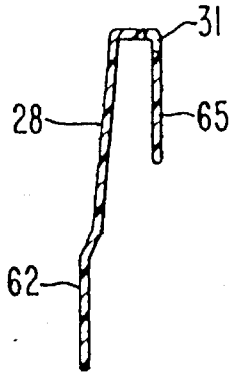
FIG. 7 is a cross section of the crate taken along line 7—7 of FIG. 3.
Figure 8:
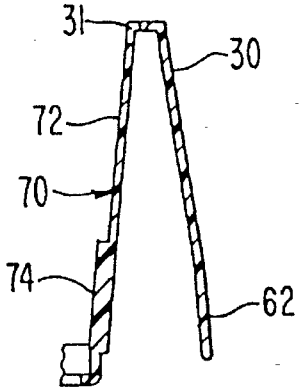
FIG. 8 is a cross section of the crate taken along line 8—8 of FIG. 3.
Figure 9:
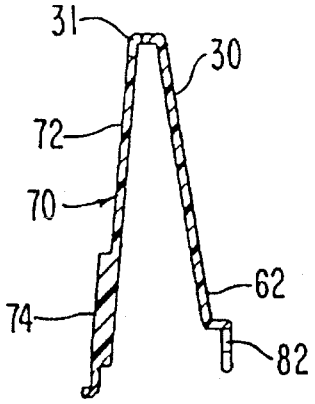
FIG. 9 is a cross section of the crate taken along line 9—9 of FIG. 3.

As shown in FIGS. 5 and 6, and cross section FIGS. 7–9, pylons 28 and 30 and 30*a* are integral with the interior lower wall portion 60 and also with exterior lower wall portion 62. Interior lower wall portion or panel 60 and exterior lower wall portion or panel 62 combine to provide a double-walled construction to crate 20 such that they are respectively contiguous with the interior and exterior surfaces of the pylons. The tops 86 of lower wall portions smoothly connect interior lower wall portion 60 to exterior lower wall portion 62. This construction ensures that crate 20 will have sufficient strength and rigidity for a variety of handling situations. As best seen in FIGS. 3, 5, 6 and 15, corner pylons 28 are sized identically but oriented differently depending upon their location. However, there are two sizes of side pylons: side pylons 30 located along sidewalls 25 and in the center of endwall 27 are sized identically, but side pylons 30*a* which are located on endwalls 27 between the center pylon and the corner pylons are slightly oversized. The difference is because to cross-stack the preferred tour-by-six array of bottles in a uniform pattern the crate must have a width to length ratio of 2:3, so approximately one and a half times the space occupied by the walls in the width direction must be accommodated by the crate in the length direction. In the crate of the present invention, this space is accommodated in an advantageous manner: by increasing the thickness of pylons 30*a* along endwalls 27. This configuration further strengthens crate 20 and also does not interfere with multi-packs for ease of automated loading and handling.

Crate profile views, FIGS. 1, 2, 5 and 6, show that exterior lower wall portion 62 is preferably not quite flush with floor bottom surface 48, such that floor bottom surface 48 is left exposed somewhat in profile. Leaving exterior lower wall portion 62 slightly higher than floor bottom surface 48 facilitates handling by allowing hand trucks to slide easily under the crate, and prevents the exterior lower wall portion from catching on bottle tops when the crate is being slid along the bottle tops as described above. The periphery of floor bottom surface 48 is finished with a beveled edge 49. In addition, the bottom surfaces of circles 52 and arcs 54 are the lowermost surfaces of the floor bottom 48. These are collectively labeled as bottom surface 53 in FIGS. 1, 2 and 4–6. The edges of bottom surface 53 are also finished with beveled surfaces 55. Therefore, when crate 20 rests on a flat surface, bottom surface 53 is in contact with the flat surface. Bevels 49 and 55 facilitate handling of the crate.

As best seen in FIG. 4, lower wall portion 26 also has an open bottom so that empty crates can be nested together. Portions of two nested crates is shown in detail in FIG. 15. For ease of explanation, the lower crate will be described using primed reference numerals, for example—upper crate 20 is nested onto or above lower crate 20'. Primed reference numerals will be used for corresponding elements.

Many of the advantages of the present invention relate to the nestability of the crates. An appreciation of the structural features which permit and facilitate nesting can be had with reference to FIGS. 5, 6 and 15. When empty crates 20 and 20' are nested, pylons 28 and 30 and 30*a* of upper crate 20 nest onto or above corresponding pylons 28' and 30' and 30*a*' of lower crate 20' such that pylons 28' and 30' and 30*a*', in effect, travel upward inside of pylons 28 and 30 and 30*a* respectively. Side pylons 30 and 30*a* are arranged between adjacent support areas 34 (or 35 as the case may be) and define spaces or windows 63 therebetween. In this manner, when crate 20 is loaded with bottles which are seated on support areas 34 and 35, the sides of the bottles are visible through windows 63 for attractive displays, especially in a retail setting.

Figure 14:
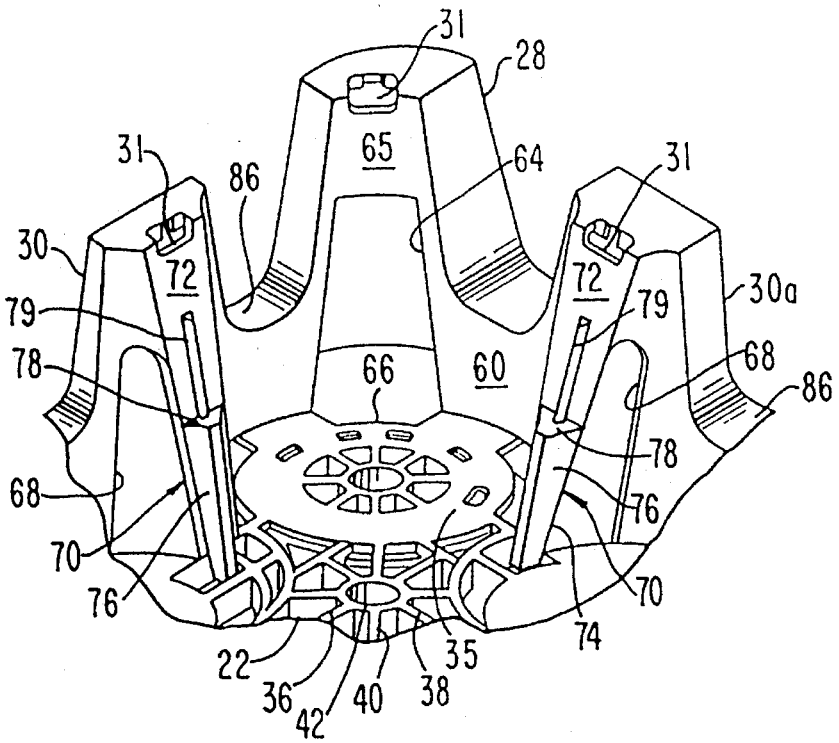
FIG. 14 is a detailed cut-away perspective view of a corner area of the crate of FIG. 1.

Corner pylons 28 preferably have apertures 64 disposed on the interior surface thereof to allow sufficient clearance for below-nested corner pylons to nest or travel into. As best seen in FIG. 14, aperture 64 in corner pylon 28 extends to floor 22 where corner support area 35 is also configured with a cut-away 66 so as to clear a below-nested corner pylon. The upper interior portions of corner pylons 28 include corner panels 65 which extend down from the tops of the corner pylons to apertures 64. Central panels 70 define bottom surfaces 75, best seen in FIG. 4. Slots 31 are provided at the juncture between the top of pylons 28 and corner panels 65.

Similarly, side pylons 30 and 30*a* are also configured to allow sufficient clearance for below-nested side pylons to nest into. The interior sides of side pylons 30 and 30*a* also have apertures 68, but instead of being left open, an integral central panel 70 having upper panel portion 72 and lower panel portion 74 extends down to floor 22. Central panels 70 are preferably angled outwardly from the floor toward the top of the pylons, anti connect the pylons to the floor. In this way, central panels 70 will extend somewhat between adjacent bottles when crate 20 is loaded with bottles. Slots 31 are also provided at the juncture between the top of pylons 30 and 30*a* and upper panel portions 72.

Figure 15:
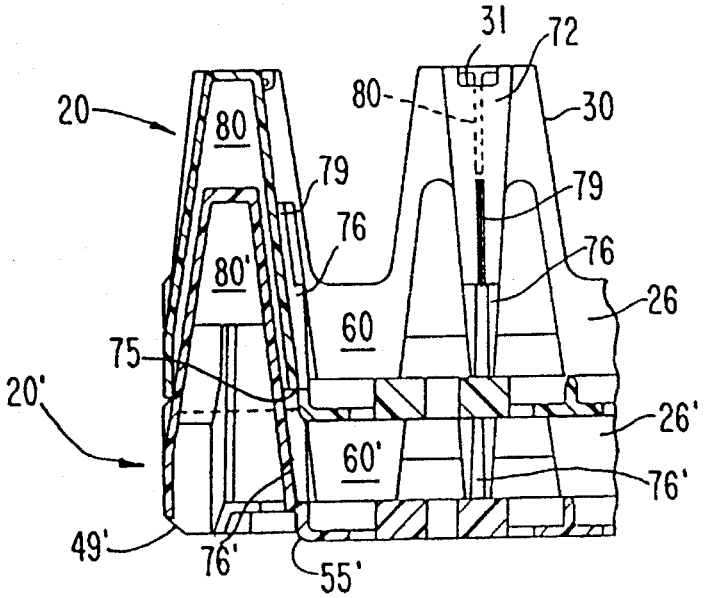
FIG. 15 is a fragmented cross sectional view similar to FIG. 5 of the crate of FIG. 1 nested with an identical empty crate.

In order to control the extent of travel inside of the pylons, at least two types of positive "stops" are preferably provided. The stops are provided to prevent nested crates from becoming wedged together, and to prevent any damage or deformation to the pylons or wall structure from repeated nesting and bearing the weight of above-nested crates. The first stop is inside the hollow pylons and the second stop is on the outside of the pylons. The outside the pylon stops 76 are integrally formed boxed-in structures on the lower panel portions 74 of side pylons 30 and 30*a*. Stops 76 extend vertically upward from floor 22, and the top ledges 78 of the stop act as bearing surfaces for panel bottom surfaces 75 when crates 20 and 20' are nested. Although any number of panel bottom surfaces 75 could conceivably rest on ledges 78' of a tray nested below, in the preferred embodiment, contact is made at the four side pylons located on sidewalls 25 directly adjacent corner pylons 28. For example, as seen in FIG. 15, panel bottom surface 75 of the upper crate 20 is disposed slightly above ledge 78' of stop 76' of the lower crate 20' when the two crates are nested. Besides acting as positive stops for nesting, stops 76 also enhance the strength of central panel 70 which connects the pylons to the floor. Stops 76 are preferably provided on all side pylons 30 and 30*a*, but the present invention is not limited to this configuration and stops 76 may be formed on fewer pylons. In conjunction with stops 76 are ribs 79 which extend upward from top edges 78 and are integral with central panels 70. Ribs 79 help strengthen the central panels of the pylons.

The inside the pylon stops or bridging ribs 80 are integrally formed in the hollow spaces inside pylons 28, 30 and 30*a*. Bridging ribs 80 are best seen in FIGS. 5, 6 and 15 in cross section, and an exemplary bridging rib 80 has been drawn in phantom line on crate 20 of FIG. 15. Ribs 80 preferably are located in the upper part of pylons 28, 30 and 30*a*, anti hidden from view by corner panels 65 of corner pylons 28 and upper panel portions 72 of side pylons 30 and 30*a*. FIG. 4 best illustrates how ribs 80 preferably span the inside of pylons 28, 30 and 30*a*, bridging their interior and exterior surfaces. When crates are nested, ribs 80 bear against the tops of pylons 28, 30 and 30*a*. Referring to FIG. 15, ribs 80 of crate 20 rest on the tops of pylons 28' and 30' and 30*a*' of lower crate 20'.

The double-walled construction of lower wall portion 26 also affords another advantageous structural feature, handles 82, preferably centrally located on endwalls 27. As described above, center pylons 30 along endwalls 27 are narrower than the other pylons 30*a*, and this configuration also permits handles 82 to be larger. Handles 82 are integrally formed on exterior lower wall portion 62 on the endwalls so that a user's hands extend into the space between interior lower wall portion 60 and exterior lower wall portion 62. When crate 20 is grasped at handles 82, exterior lower wall portion 62 provides a comfortable, smooth resting surface for the hands of the user.

An additional feature of the present invention is the provision of a flat label section 84 formed as part of exterior lower wall portion 62 for molding in logos, advertisements or the like.

The crate of the present invention combines the features of nestability, strength and visibility. In constructing the crate, many design parameters must be determined with the goal of enhancing the above mentioned characteristics without unduly sacrificing any of them. Visibility is important both for permitting attractive display but also for ensuring that UPC labels on the sides of the bottles may be read or scanned through windows 63 without having to remove the bottles. Increasing visibility of the bottles, that is, enlarging windows 63 between the pylons means decreasing the size of the pylons which results in an overall reduction in strength. In addition, large windows increases the chance of bottles hopping out of the crate through the windows. The present invention provides maximum visibility for its size without sacrificing strength and nestability.

Similarly, nestability is all important feature for conserving space and ease of handling. The height that a crate acids to a stack of nested crates is the nesting increment. In the first preferred embodiment of the present invention, the nesting increment is preferably approximately 1.5 inches for a crate having an overall height of about 3.95 inches. The nesting ratio is calculated by dividing the height by the increment: in this example 3.95/1.5=2.63. The pylons, therefore, extend approximately 2.5 inches above the lower wall portion, and are approximately 2.9 inches apart on center. Obviously, the larger the nesting ratio, or the smaller the nesting increment, the more space is conserved. However, as with the other design parameters, simply increasing the nesting ratio results in other trade offs. Increasing the nesting ratio decreases the strength and integrity of the crate since, among other adjustments, the lower wall portion must be made smaller thereby sacrificing needed strength anti rigidity.

The preferred dimension of a sidewall of the first preferred embodiment of crate 20 is approximately 18.9 inches and the endwall approximately 12.6 inches. As mentioned above, the height of the crate described is approximately 3.9 inches, but the height of the crate depends on the contour of the bottles since some types of bottles require a deeper crate for retention. Side pylons 30 are approximately 0.4 inches thick at their tops, while larger pylons **30*a*** are approximately 0.6 inches thick at their tops. The side pylons are angled toward the inside of the crate with the exterior side of the pylons extending up from the exterior lower wall portion angled inward approximately 5.7° and meeting the substantially flat top surfaces of the pylons. The central panels are angled outward from the floor upward, approximately 9.2° off the vertical, meeting the flat top surfaces of the pylons. The corner pylons are angled toward the inside of the crate with the exterior side of the corner pylons extending up from the exterior lower wall portion approximately 5.7° of the vertical to meet the that top surfaces of the corner pylons. The corner panel is substantially vertical. The windows are defined by the sides of the pylons which are approximately 8° off the vertical, such that the windows are progressively wider toward the top of the pylons. Obviously the dimensions of the other preferred embodiments will vary.

The dimensions and angles described above pertain to the preferred embodiment of the present invention, and represents the optimum balance of nestability, strength and visibility. Of course adjustments may be made as needed for differently contoured or sized bottles or containers, and the present invention is in no way limited to the dimensions set forth above.

The other embodiments of the invention will be described using the same reference numerals for corresponding features but prefixed by a different digit in the hundreds.

As discussed above, the exact number of support areas can be varied to yield crates having different capacities from crate 20. In addition, the rate can be sized up or down for holding smaller or larger containers as desired. The following description pertains to further embodiments of the crate.

Figure 16:
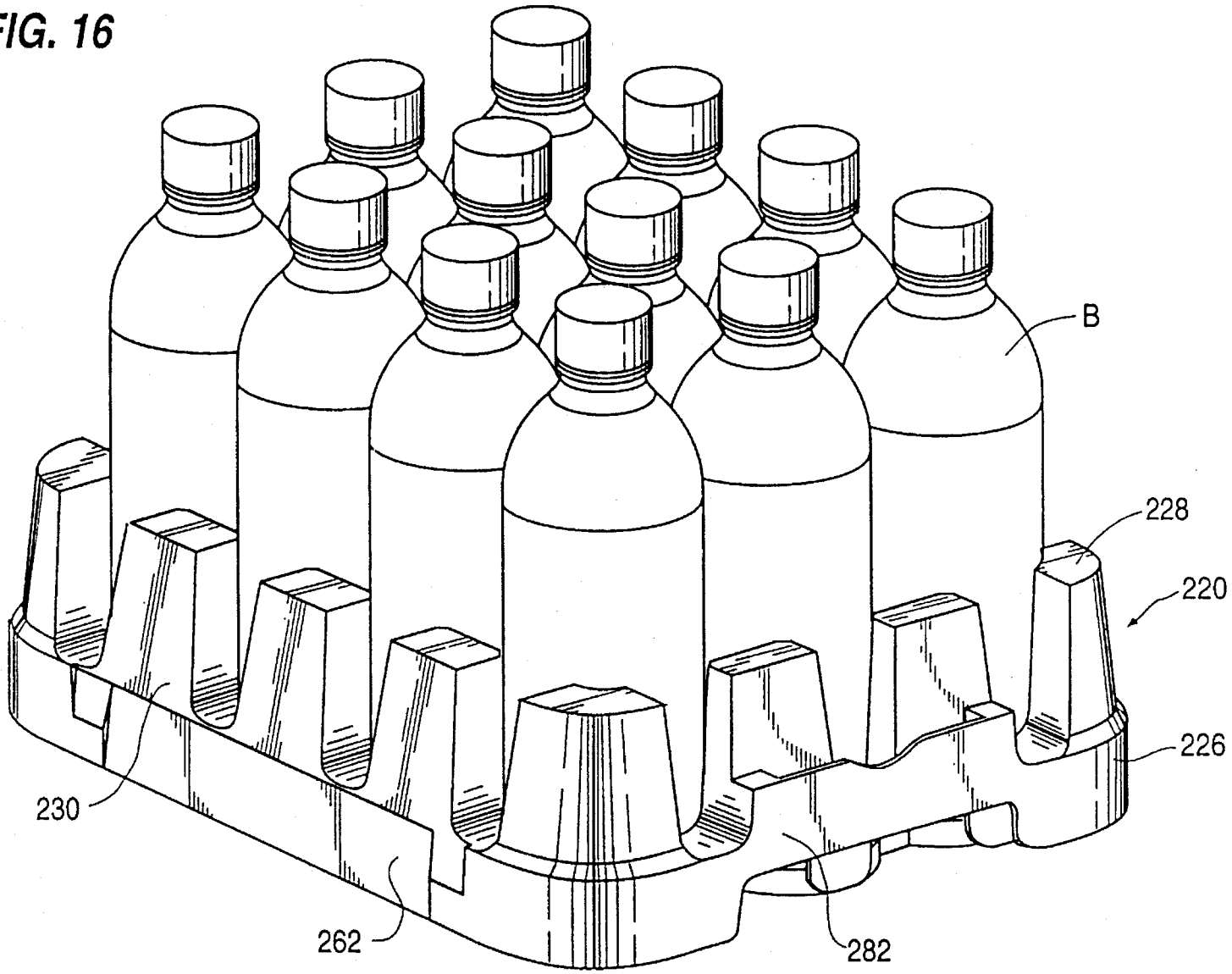
FIG. 16 is a perspective view of a crate in accordance with the second preferred embodiment of the present invention, loaded with bottles arranged in a three by four array.

The second preferred embodiment of the invention is shown in FIG. 16 as crate 220. Crate 220 is preferably constructed for holding a three by four array of one liter bottles B. Adjustments have been made for the size differential, but otherwise the other essential features of crate 20 are retained.

Figure 17:
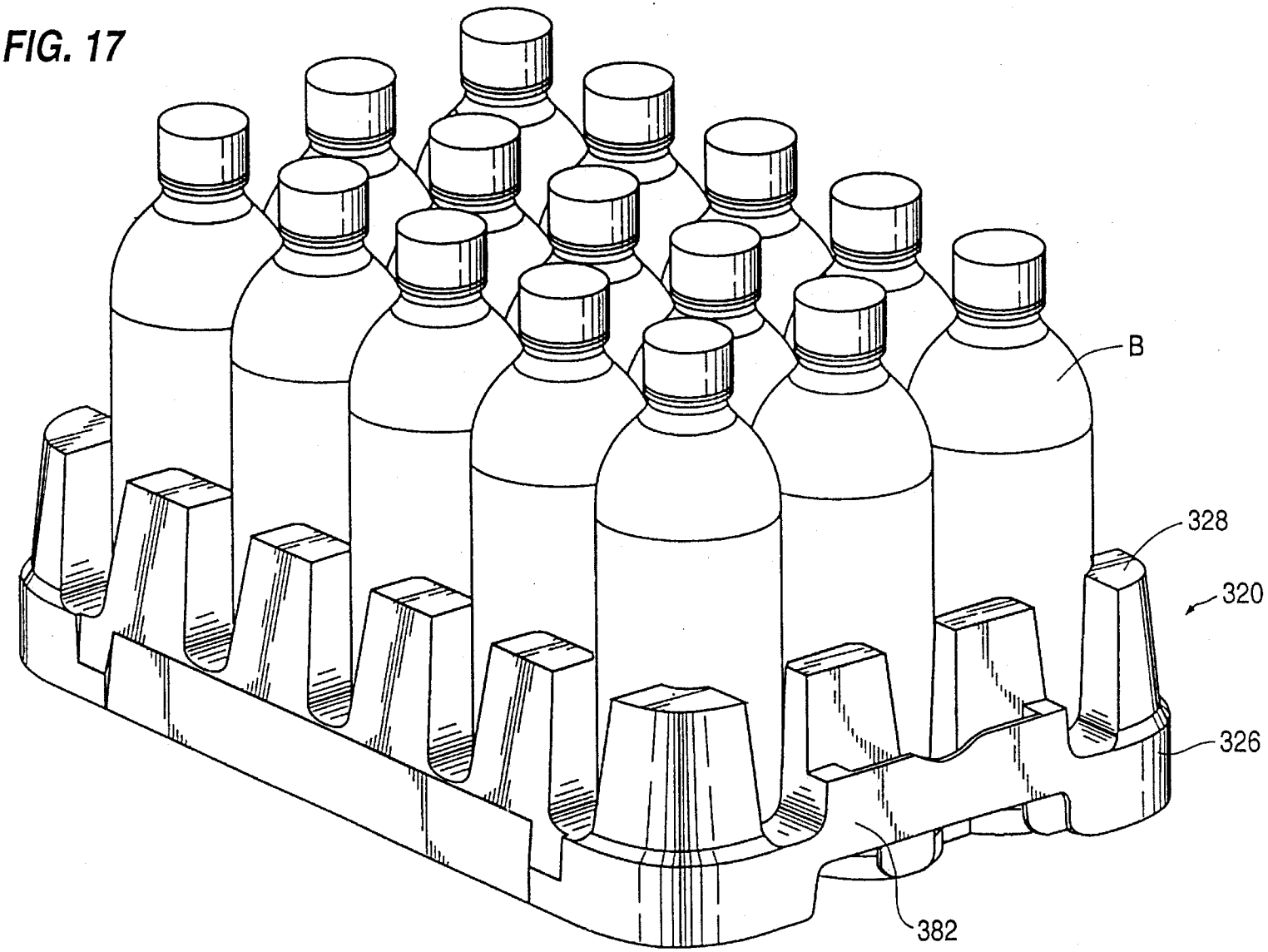
FIG. 17 is a perspective view of a crate in accordance with a third embodiment of the present invention, loaded with bottles in a three by five array.

Similarly, the third preferred embodiment of the invention is shown in FIG. 17 as crate 320. Crate 320 is constructed for holding a three by five array of one liter bottles B.

Figure 18:
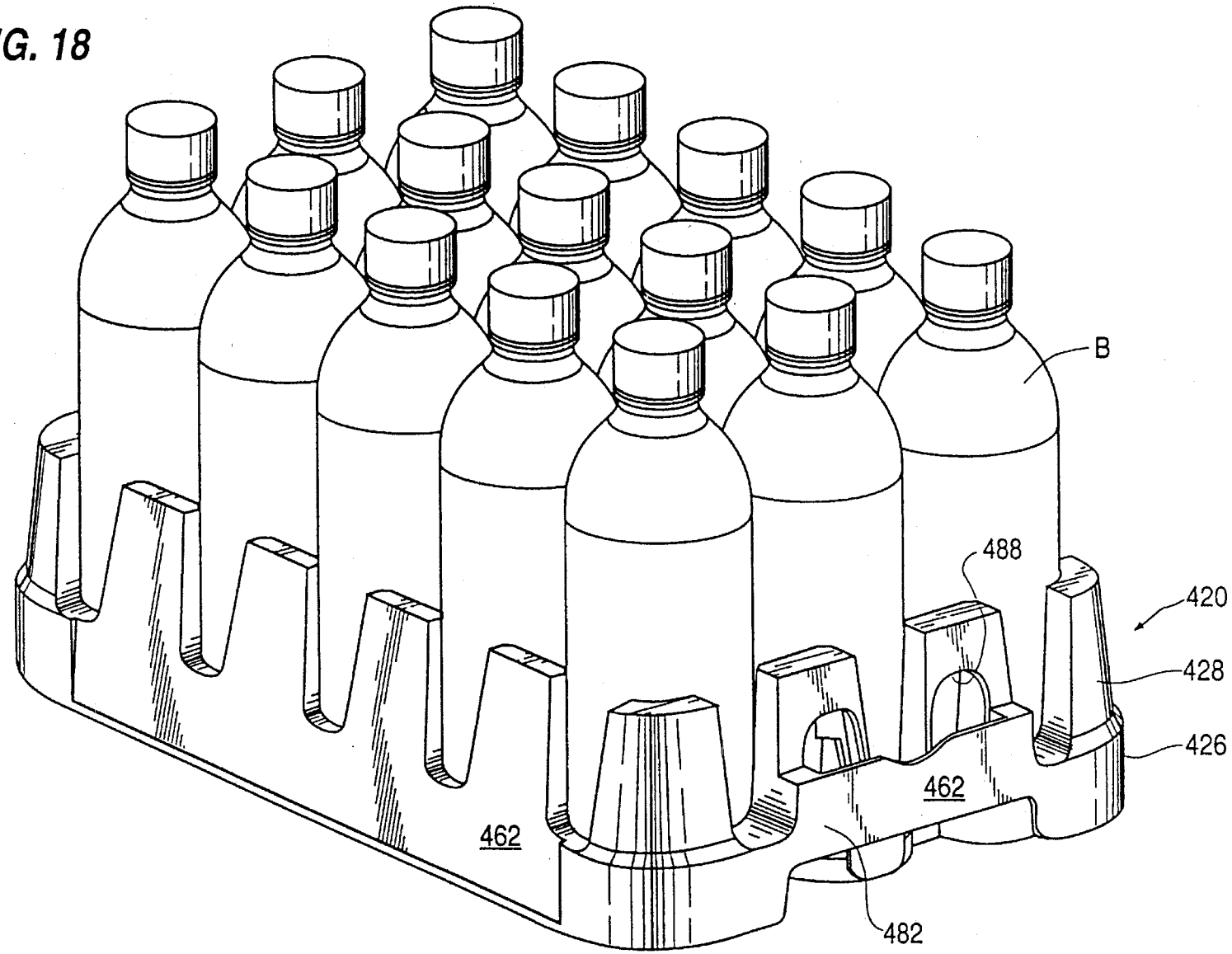
FIG. 18 is a perspective view of a crate in accordance with a fourth embodiment of the present invention, loaded with bottles in a three by five array.

The fourth preferred embodiment of the invention is shown in FIG. 18 as crate 420. Crate 420 is also constructed holding a three by five array of one liter bottles B.

One main difference between crates 220, 320, 420 and crate 20 is in the handle construction. Handles 282, 382 and 482 on crates 220, 320 and 420, respectively, are of triple wall construction and can best be explained with reference to FIG. 19. For ease of explanation the reference numerals of crate 220 will be used, and it will be understood that crates 320 and 420 have corresponding handle features.

Figure 19:
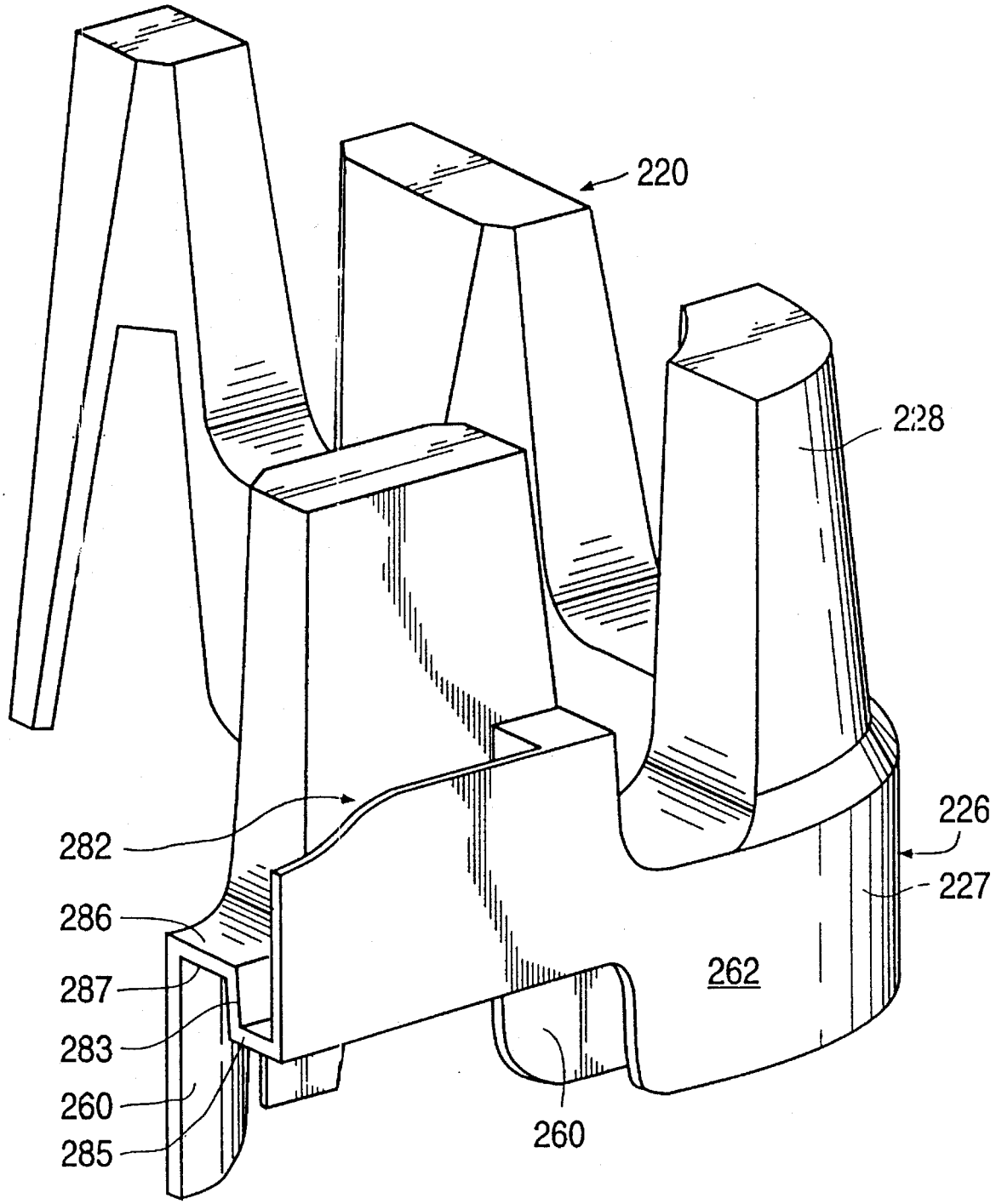
FIG. 19 is a perspective, schematic cut-away view of the wall structure of the crates of FIGS. 16 and 17 at the handle region.

Handle 282 of FIG. 19 comprises a triple walled area with the outermost section being integral with exterior lower wall portion 262, anti the innermost section being integral with interior lower wall portion 260.

Exterior portion 262 is spaced further away from interior portion 260 at endwalls 227 so that lower wall portion 226 is bulkier at the endwalls. In these embodiments exterior lower portion 262 at endwalls 227 are not contiguous with the exterior sides of pylons 230 as in crate 20. A middle wall 283 is integrally formed between exterior portion 262 and interior portion 260, and is contiguous with the exterior sides of pylons 230. Middle wall 283 is connected to exterior portion 262 by a bridging member 285 which is preferably spaced some distance above floor bottom surface 248, but below the top surface 286 of lower wall portion 226. Thus, a handle cavity 287 is formed between middle wall 283 and interior portion 260.

In use, handle 282 allows both "palm-up" and "palm-down" gripping. In constructing crate 420, cut-outs 488 were made on the outside of pylons 430 to provide more room for a user's hands to grasp the handle.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely only by the claims appended hereto.

I claim:

1. A crate for containers, the crate having a floor and a wall structure integral with the floor, the floor having a floor top surface and floor bottom surface, the floor top surface having thereon a plurality of support areas for supporting an array of containers, the wall structure integral with the floor and extending around the periphery thereof, the improvement comprising:

a lower wall portion adjacent and integral with the floor, wherein said lower wall portion is of double-walled construction and includes an interior lower wall portion and an exterior lower wall portion connected by a top surface; and a plurality of tapered pylons extending up from the floor and beyond the top of said lower wall portion, said pylons spaced along the periphery of the floor and defining spaces therebetween through which containers loaded in said crate are visible, and wherein the interior surfaces of said pylons are integral with said interior lower wall portion and the exterior surfaces of said pylons are integral with said exterior lower wall portion.

2. The crate of claim 1, wherein said pylons are angled toward the inside of said crate, and hollow through at least a lower portion thereof so as to allow said pylons to nest onto corresponding pylons in a similar crate therebeneath.

3. The crate of claim 2, wherein said pylons comprise corner pylons disposed at the corners of said crate, each of said corner pylons including a corner aperture, and side pylons disposed along the sides of said crate, each of said side pylons including a nesting aperture and a central panel extending down from the top of said side pylon to be integral with the floor, said central panel bisecting said nesting aperture, wherein said corner apertures and said nesting apertures provide sufficient clearance for said corner pylons to nestingly receive corresponding corner pylons and said side pylons to nestingly receive corresponding side pylons of a similar crate.

4. The crate of claim 3 further comprising stop means for limiting inward travel of a below-nested pylon into a corresponding pylon thereabove to prevent nested crates from becoming wedged together.

5. The crate of claim 4, wherein said stop means comprises bridging ribs in upper portions of a number of said pylons, such that when nested, said bridging ribs of said crate rest on the tops of corresponding pylons of a similar crate therebelow.

6. The crate of claim 5, wherein said stop means further comprises a number of said side pylons having a stop on said central panel thereof, such that when said crate is nested below a similar crate, each said stop provides a nesting ledge on which rests the bottom surface of said central panel of a corresponding pylon of the similar crate.

7. The crate of claim 6, wherein the floor bottom surface includes a plurality of recessed container top receiving areas to receive the tops of containers loaded in a similar crate therebelow for maintaining a stable stacked or cross-stacked configuration of loaded crates.

8. The crate of claim 7, wherein the periphery of each of said receiving areas is beveled to facilitate disengagement of the container tops from said receiving areas.

9. The crate of claim 8, wherein each of said receiving areas includes at least two receiving zones, each receiving zone constructed to engage different sizes of container tops.

10. The crate of claim 9, wherein the floor bottom surface extends slightly below said exterior lower wall portion.

11. The crate of claim 10, wherein said lower wall portion includes handles integrally formed therein.

12. A crate for containers, the crate having a floor and a wall structure integral with the floor, the floor having a floor top surface and floor bottom surface, the floor top surface having thereon a plurality of support areas for supporting an array of containers, the wall structure integral with the floor and extending around the periphery thereof, the improvement comprising:

a lower wall portion adjacent and integral with the floor, wherein said lower wall portion is of double-walled construction and includes an interior lower wall portion anti an exterior lower wall portion: and a plurality of tapered pylons extending up from the floor and beyond the top of said lower wall portion, said pylons spaced along the periphery of the floor and defining spaces therebetween through which containers loaded in said crate are visible, wherein the interior surfaces of said pylons are integral with said interior lower wall portion and the exterior surfaces of said pylons are integral with said exterior lower wall portion, and wherein said pylons are angled toward the inside of said crate, and hollow through at least a lower portion thereof so as to allow said pylons to nest onto corresponding pylons in a similar empty crate therebeneath.

13. The crate of claim 12, further comprising stop means for limiting inward travel of a below-nested pylon into a corresponding pylon thereabove to prevent nested crates from becoming wedged together.

14. The crate of claim 13, wherein said stop means comprises bridging ribs in upper portions of a number of said pylons, such that when nested, said bridging ribs of said crate rest on the tops of corresponding pylons of a similar crate therebelow.

15. The crate of claim 14, wherein said pylons comprise corner pylons disposed at the corners of said crate, cacti of said corner pylons including a corner aperture, side pylons disposed along the sides of said crate, each of said side pylons including a nesting aperture and a central panel extending clown from the top of said side pylon to be integral with the floor, said central panel bisecting said nesting aperture, wherein said corner apertures and said nesting apertures provide sufficient clearance for said corner pylons to nestingly receive corresponding corner pylons and said side pylons to nestingly receive corresponding side pylons of a similar crate.

16. The crate of claim 15, wherein said stop means further comprises a number of said side pylons having a stop on said central panel thereof, such that when said crate is nested below a similar crate, each said stop provides a nesting ledge on which rests the bottom surface of said central panel of a corresponding pylon of the similar crate.

17. The crate of claim 16, wherein the floor bottom surface includes a plurality of recessed container top receiving areas to receive the tops of containers loaded in a similar crate therebelow for maintaining a stable stacked or cross-stacked configuration of loaded crates, and wherein the periphery of each of said receiving areas is beveled to facilitate disengagement of the container tops from said receiving areas.

18. The crate of claim 17, wherein each of said receiving areas includes at least two receiving zones, each receiving zone constructed to engage different sizes of container tops.

19. The crate of claim 18, wherein the floor bottom surface extends slightly below said exterior lower wall portion.

20. The crate of claim 12, wherein the floor bottom surface extends slightly below said exterior lower wall portion.

* * * * *

UNITED STATES PATENT AND TRADEMARK OFFICE

CERTIFICATE OF CORRECTION

PATENT NO. :5,465,843
DATED : November 14, 1995
INVENTOR(S) : Gerald R. Koefelda It is certified that error appears in the above-identified patent and that said Letters Patent is hereby corrected as shown below:

Claim 12,
Column 12,
Line 2, "anti" should read "and"
Line 2, after "portion" delete ":" and insert ";"

Claim 15,
Column 12,
Line 26, delete "cacti" and insert "each"
Line 30, delete "clown" and insert "down"

Signed and Sealed this

Nineteenth Day of June, 2001

*Attest:*

Nicholas P. Godici

*Attesting Officer*

NICHOLAS P. GODICI
*Acting Director of the United States Patent and Trademark Office*